US006880675B2

(12) United States Patent
Huang

(10) Patent No.: US 6,880,675 B2
(45) Date of Patent: Apr. 19, 2005

(54) MULTIFUNCTIONAL ADJUSTABLE LADDER ASSEMBLY

(76) Inventor: Kuo-Ching Huang, 58, Ma Yuan West St., Taichung (TW)

( * ) Notice: Subject to any disclaimer, the term of this patent is extended or adjusted under 35 U.S.C. 154(b) by 33 days.

(21) Appl. No.: 10/423,607

(22) Filed: Apr. 25, 2003

(65) Prior Publication Data

US 2003/0221910 A1 Dec. 4, 2003

Related U.S. Application Data

(63) Continuation-in-part of application No. 10/156,947, filed on May 30, 2002, now abandoned.

(51) Int. Cl.[7] ..... E06C 1/00
(52) U.S. Cl. ..... 182/195; 182/166; 182/204
(58) Field of Search ..... 182/195, 194, 182/204, 207, 215, 111, 228, 166, 167, 156

(56) References Cited

U.S. PATENT DOCUMENTS

| | | | | | |
|---|---|---|---|---|---|
| 722,409 | A | * | 3/1903 | Paskell | 182/166 |
| 763,209 | A | * | 6/1904 | Schwalbe | 182/156 |
| 803,783 | A | * | 11/1905 | Pfeifer et al. | 182/166 |
| 870,940 | A | * | 11/1907 | Dahl | 182/166 |
| 1,192,734 | A | * | 7/1916 | Bennett | 182/166 |
| 1,441,529 | A | * | 1/1923 | Saccone | 182/125 |
| 2,127,949 | A | * | 8/1938 | Zeman | 182/104 |
| 2,194,856 | A | * | 3/1940 | Kostuk | 182/126 |
| 2,396,028 | A | * | 3/1946 | Spayd | 182/166 |
| 2,827,216 | A | * | 3/1958 | Napolitano | 182/104 |
| 3,858,684 | A | * | 1/1975 | Goings | 182/207 |
| 5,265,698 | A | * | 11/1993 | Friedel, Jr. | 182/201 |
| 6,073,726 | A | * | 6/2000 | McCrystal | 182/195 |
| 6,129,179 | A | * | 10/2000 | Rooney et al. | 182/156 |
| 6,595,326 | B1 | * | 7/2003 | Dean | 182/204 |
| 6,698,550 | B1 | * | 3/2004 | Crain | 182/166 |
| 2002/0007981 | A1 | * | 1/2002 | Stoneburg | 182/204 |
| 2002/0084143 | A1 | * | 7/2002 | Roy | 182/204 |
| 2003/0079942 | A1 | * | 5/2003 | Pettit | 182/115 |
| 2004/0020718 | A1 | * | 2/2004 | Kieffer et al. | 182/195 |

* cited by examiner

*Primary Examiner*—Bruce A. Lev
(74) *Attorney, Agent, or Firm*—Alan D. Kamrath; Nikolai & Mersereau, P.A.

(57) ABSTRACT

A ladder assembly includes two symmetric support stands pivotally connected with each other. Each of the two support stands includes a main frame, an upper frame, a lower frame, a top bar, a retraction control unit, and four fixing devices. Thus, height of the ladder assembly can be adjusted easily and conveniently, thereby facilitating the user operating the ladder assembly. In addition, the upper frame and the lower frame can be folded on the main frame, so as to reduce the volume the ladder assembly efficiently, thereby greatly facilitating storage and transportation of the ladder assembly.

16 Claims, 8 Drawing Sheets

MULTIFUNCTIONAL ADJUSTABLE LADDER ASSEMBLY

CROSS-REFERENCES TO RELATED APPLICATIONS

The present invention is a continuation-in-part application of the U.S. Ser. No. 10/156,947, filed on May 30, 2002 now abandoned.

BACKGROUND OF THE INVENTION

1. Field of the Invention

The present invention relates to a ladder assembly, and more particularly to a multifunctional adjustable ladder assembly.

2. Description of the Related Art

The ladder is available for various sites so that the user can climb up the ladder to facilitate the user's work. However, the conventional ladder has a fixed height without adjustment, thereby causing inconvenience to the user when the conventional ladder is used in an uneven surface or rugged road. In addition, the conventional ladder has larger volume and cannot be folded, thereby causing inconvenience in storage and transportation.

SUMMARY OF THE INVENTION

The primary objective of the present invention is to provide a ladder assembly, wherein the height of the ladder assembly can be adjusted easily and conveniently, thereby facilitating the user operating the ladder assembly.

Another objective of the present invention is to provide a ladder assembly, wherein the upper frame and the lower frame can be folded on the main frame, so as to reduce the volume the ladder assembly efficiently, thereby greatly facilitating storage and transportation of the ladder assembly.

A further objective of the present invention is to provide a ladder assembly, wherein the distance between the upper frame and the main frame and the distance between the lower frame and the main frame of each of the two support stands can be adjusted individually, so that the ladder assembly is available for an uneven or rugged site.

In accordance with the present invention, there is provided a ladder assembly, comprising two symmetric support stands pivotally connected with each other, wherein:

- each of the two support stands includes a main frame, an upper frame, and a lower frame;
- the main frame includes two main uprights;
- the upper frame is mounted on an upper portion of the main frame and includes two upper uprights each adjustably mounted on an upper portion of a respective one of the two main uprights of the main frame; and
- the lower frame is mounted on a lower portion of the main frame and includes two lower uprights each adjustably mounted on a lower portion of a respective one of the two main uprights of the main frame.

Further benefits and advantages of the present invention will become apparent after a careful reading of the detailed description with appropriate reference to the accompanying drawings.

DETAILED DESCRIPTION OF THE INVENTION

Figure 1:
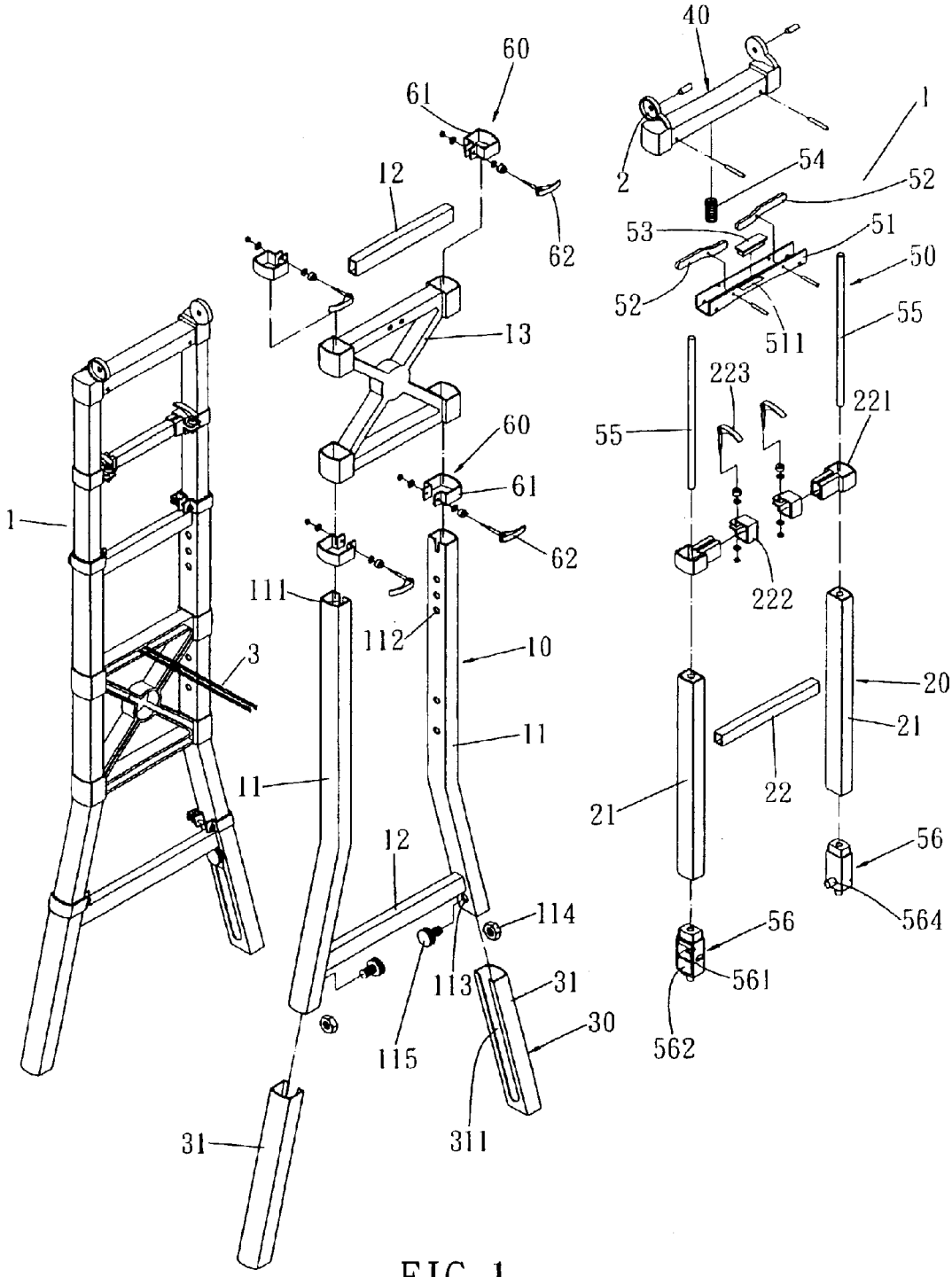
FIG. 1 is an exploded perspective view of the ladder assembly in accordance with the preferred embodiment of the present invention.

Referring to the drawings and initially to FIGS. 1–4, a ladder assembly in accordance with the preferred embodiment of the present invention comprises two symmetric support stands 1 whose top ends are pivotally connected by a pivot member 2 and whose mediate portions are connected by a chain 3, so that the user's two legs can control the two support stands 1 to move, thereby facilitating the user's work during movement.

Each of the two support stands 1 includes a main frame 10, an upper frame 20, a lower frame 30, a top bar 40, a retraction control unit 50, and four fixing devices 60.

The main frame 10 includes two main uprights 11 each having a lower end inclined outward, two crossbars 12 each mounted between the two main uprights 11, and a support strut 13 mounted between the two main uprights 11. Each of the two main uprights 11 has an inner side face having an upper end formed with a longitudinal channel 111 and a plurality of positioning holes 112 located under the longitudinal channel 111, and a lower end formed with a through hole 113. The main frame 10 further includes two locking nuts 114 each mounted in a respective one of the two main uprights 11, and two positioning bolts 115 each extended through the through hole 113 of a respective one of the two main uprights 11 and each screwed into a respective one of the two locking nuts 114.

The upper frame 20 is mounted on an upper portion of the main frame 10 and includes two upper uprights 21 each adjustably mounted on an upper portion of a respective one of the two main uprights 11 of the main frame 10, and a movable crossbar 22 mounted between the two upper uprights 21. The movable crossbar 22 of the upper frame 20 has two ends each combined with a fastener member 221 which is fixed on the respective upper upright 21 by a clip 222 and a quick release member 223.

The lower frame 30 is mounted on a lower portion of the main frame 10 and includes two lower uprights 31 each adjustably mounted on a lower portion of a respective one of the two main uprights 11 of the main frame 10. Each of the two lower uprights 31 of the lower frame 30 an inner side face formed with an elongated guide slot 311 to receive a respective one of the two positioning bolts 115.

Figures 2, 2A:
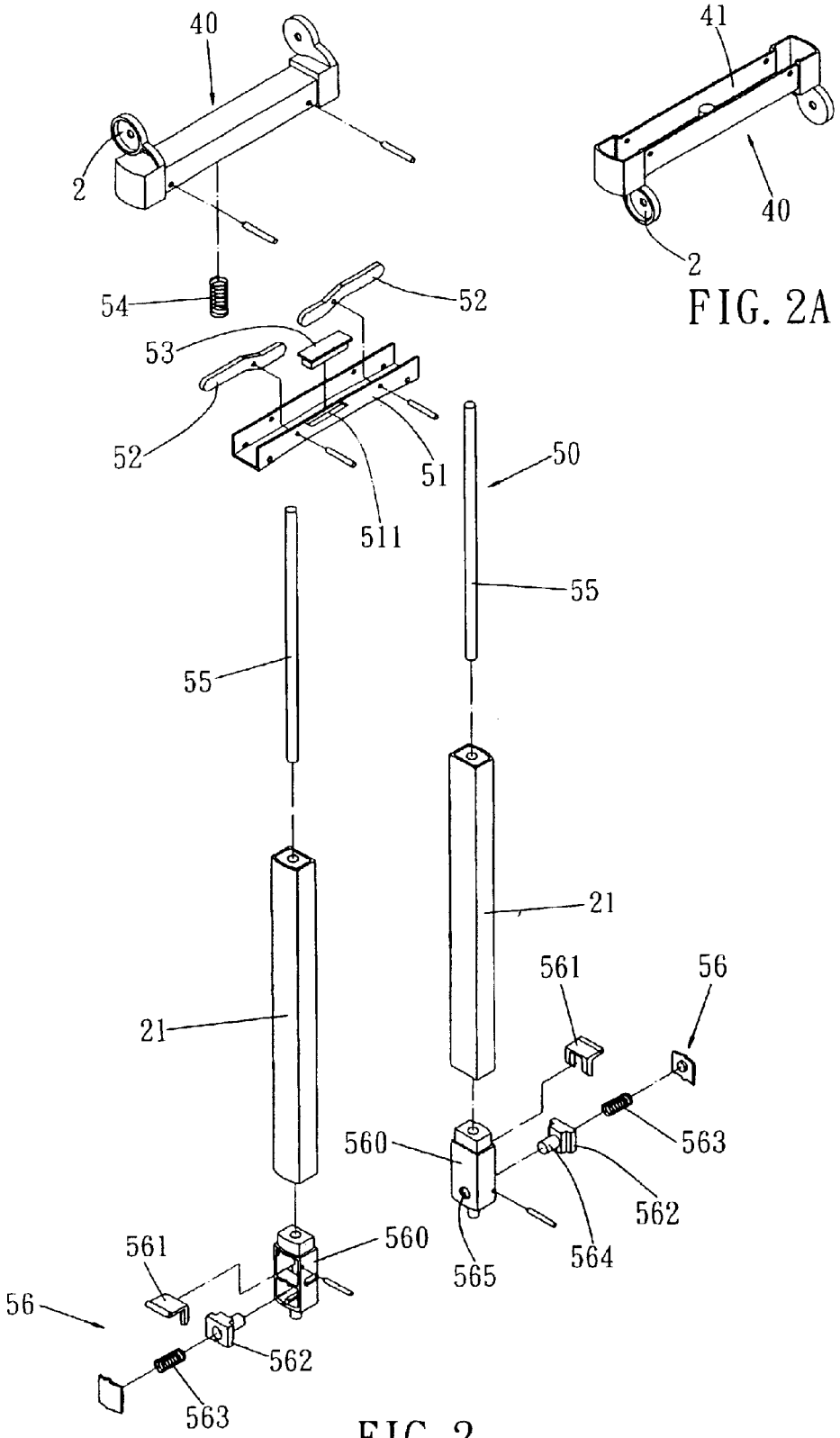
FIG. 2 is a partially exploded perspective view of the ladder assembly in accordance with the preferred embodiment of the present invention.
FIG. 2A is a perspective view of a top bar of the ladder assembly in accordance with the preferred embodiment of the present invention.

The top bar 40 is mounted on an upper portion of the upper frame 20 and has a bottom face formed with a receiving chamber 41 (see FIG. 2A).

The retraction control unit 50 includes a support seat 51, two linking members 52, a press button 53, a compression spring 54, two operation rods 55, and two control seats 56.

The support seat 51 of the retraction control unit 50 is mounted in the receiving chamber 41 of the top bar 40 and has a mediate portion formed with an operation slot 511.

Each of the two linking members 52 of the retraction control unit 50 is pivotally mounted on the support seat 51.

The press button 53 of the retraction control unit 50 is slidably mounted in the operation slot 511 of the support seat 51 and has two ends each rested on a first end of a respective one of the two linking members 52.

The compression spring 54 of the retraction control unit 50 is mounted in the receiving chamber 41 of the top bar 40 and urged between the press button 53 and a top wall of the top bar 40.

Each of the two operation rods 55 of the retraction control unit 50 is slidably mounted in a respective one of the two upper uprights 21 of the upper frame 20 and has an upper end pivotally mounted on a second end of a respective one of the two linking members 52.

Each of the two control seats 56 of the retraction control unit 50 is mounted on a lower end of a respective one of the two upper uprights 21 of the upper frame 20 to move therewith. Each of the two control seats 56 of the retraction control unit 50 includes a hollow body 560 formed with a through hole 565, a locking member 562 slidably mounted in the hollow body 560 and provided with a locking stub 564 extended through the through hole 565 and detachably locked in one of the positioning holes 112 of a respective one of the two main uprights 11, a restoring spring 563 mounted in the hollow body 560 and urged between the locking member 562 and a wall of the hollow body 560, and a control plate 561 pivotally mounted in the hollow body 560 and having a first end connected to a lower end of a respective one of the two operation rods 55 and a second end connected to the locking member 562 for moving the locking member 562 to detach from the respective positioning hole 112.

Each of the four fixing devices 60 includes a clamping member 61 and a quick release member 62, wherein two of the four fixing devices 60 combine the two upper uprights 21 on the two main uprights 11, and the other two of the four fixing devices 60 combine the two lower uprights 31 on the two main uprights 11.

Figure 3:
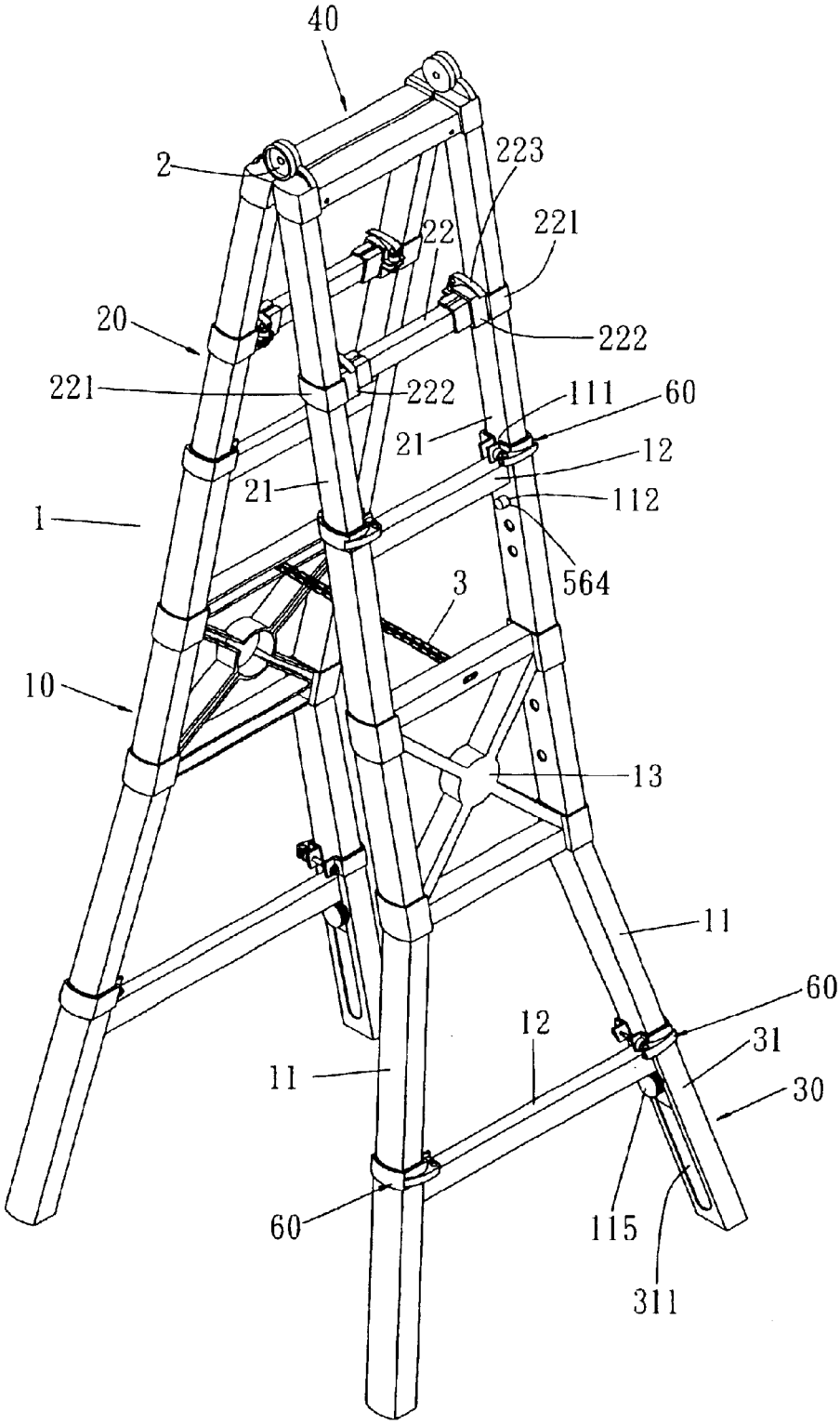
FIG. 3 is a perspective assembly view of the ladder assembly in accordance with the preferred embodiment of the present invention.
Figure 4:
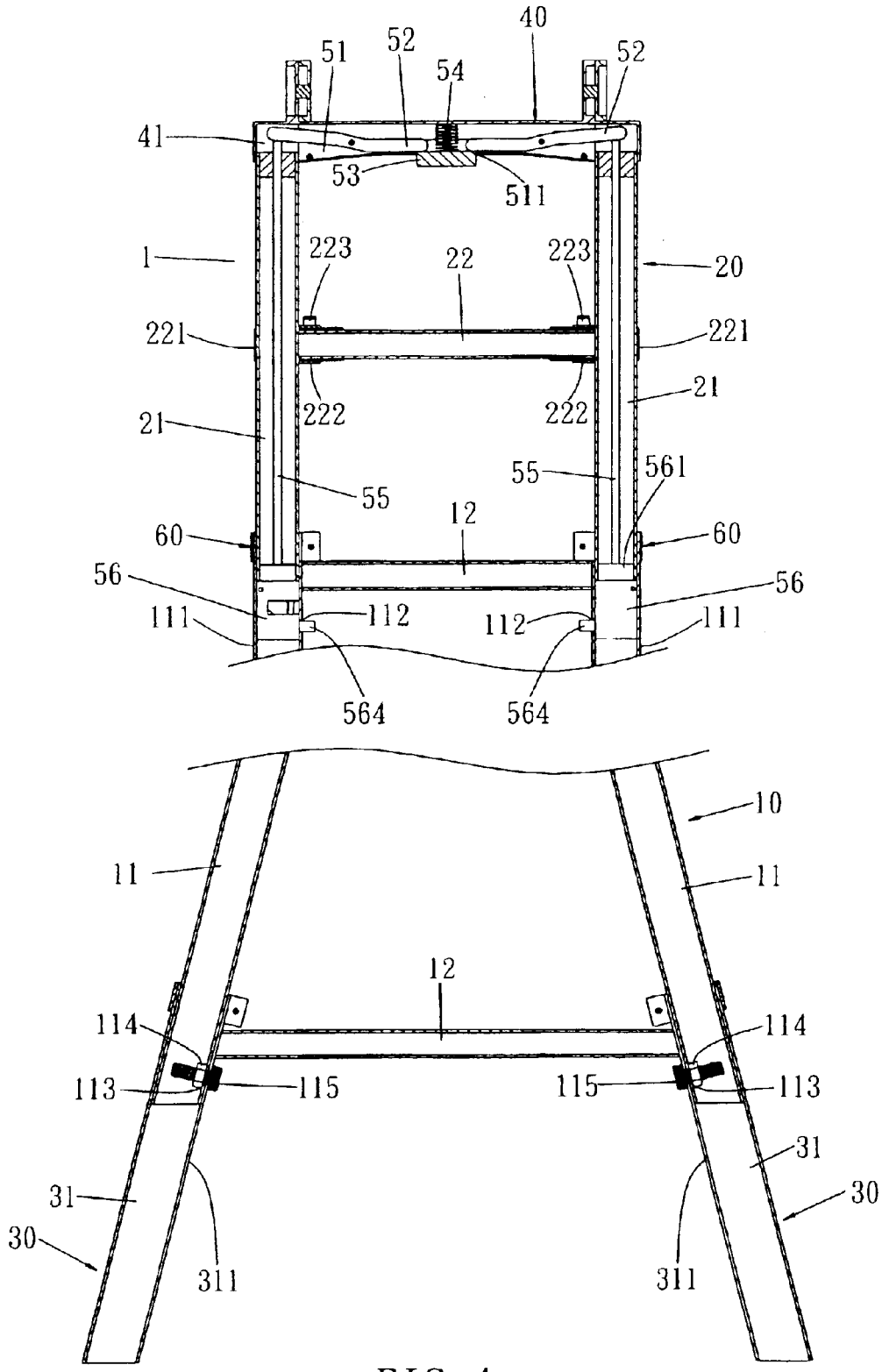
FIG. 4 is a partially cut-away side plan cross-sectional view of the ladder assembly as shown in FIG. 3.
Figure 5:
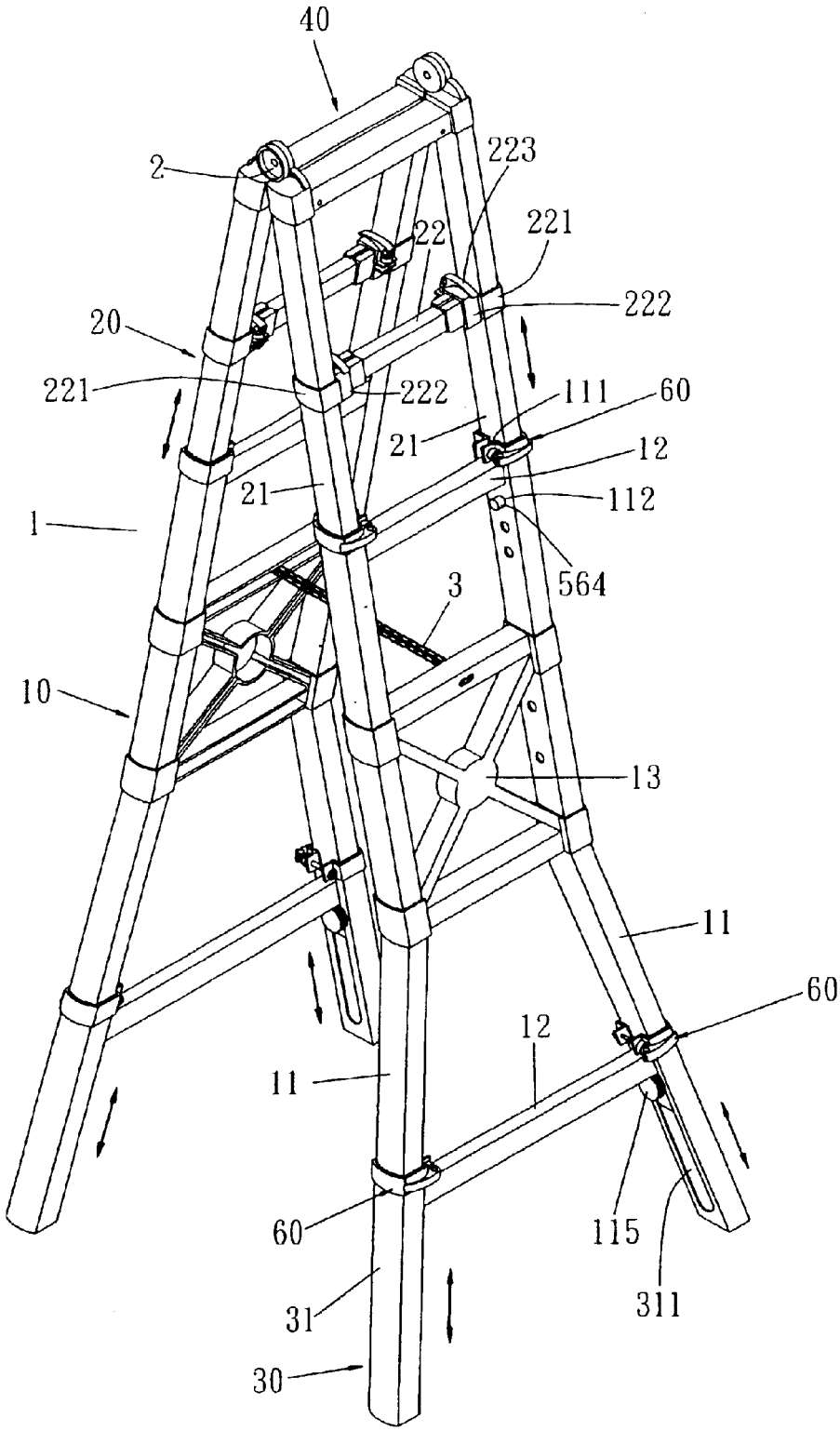
FIG. 5 is a schematic operational view of the ladder assembly as shown in FIG. 3 in use.
Figure 6:
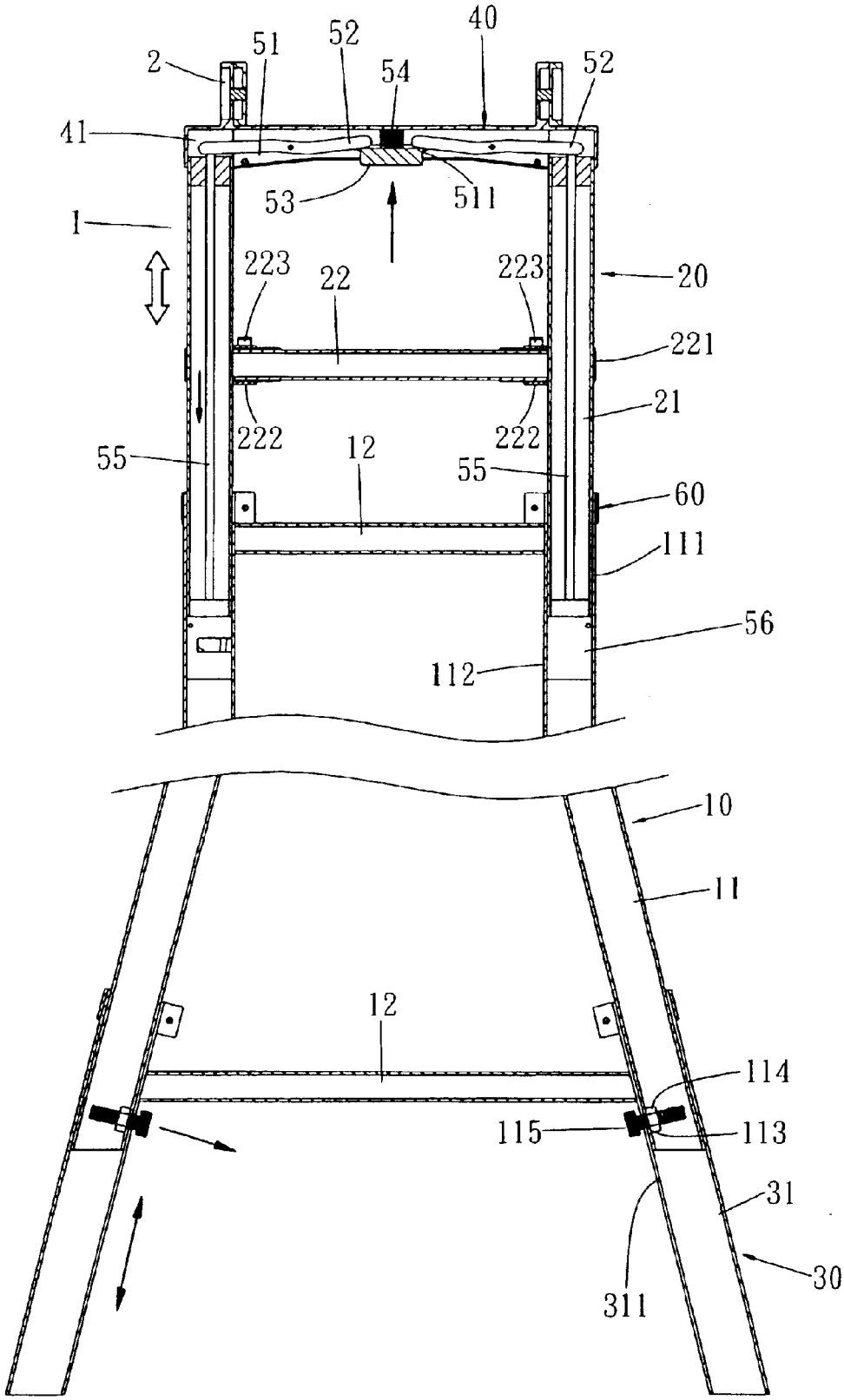
FIG. 6 is a schematic operational view of the ladder assembly as shown in FIG. 4 in use.

In assembly, each of the two linking members 52 of the retraction control unit 50 is pivotally mounted on the support seat 51. Then, the press button 53 of the retraction control unit 50 is slidably mounted in the operation slot 511 of the support seat 51 with each of its two ends being rested on the first end of a respective one of the two linking members 52. Then, the support seat 51 of the retraction control unit 50 is mounted in the receiving chamber 41 of the top bar 40, with the compression spring 54 of the retraction control unit 50 being urged between the press button 53 and the top wall of the top bar 40. Then, each of the two upper uprights 21 of the upper frame 20 is mounted on the top bar 40. Then, each of the two operation rods 55 of the retraction control unit 50 is slidably mounted in a respective one of the two upper uprights 21 of the upper frame 20, and the upper end of each of the two operation rods 55 is rested on the second end of a respective one of the two linking members 52. Then, each of the two control seats 56 of the retraction control unit 50 is mounted on the lower end of a respective one of the two upper uprights 21 of the upper frame 20, and the control plate 561 of each of the two control seats 56 is rested on the lower end of a respective one of the two operation rods 55. Then, each of the two upper uprights 21 of the upper frame 20 is inserted into the upper portion of a respective one of the two main uprights 11 of the main frame 10, and the locking stub 564 of the locking member 562 of each of the two control seats 56 is detachably locked in one of the positioning holes 112 of a respective one of the two main uprights 11, so that each of the two upper uprights 21 is fixed on the upper portion of the respective main upright 11. Then, two of the four fixing devices 60 combine the two upper uprights 21 on the two main uprights 11. Then, each of the two lower uprights 31 the lower frame 30 is mounted on the lower portion of a respective one of the two main uprights 11 of the main frame 10, and is locked by a respective one of the two positioning bolts 115. Then, the other two of the four fixing devices 60 combine the two lower uprights 31 on the two main uprights 11, thereby assembling the ladder assembly as shown in FIG. 3.

In operation, referring to FIGS. 3–6 with reference to FIGS. 1 and 2, the two fixing devices 60 mounted on the two lower uprights 31 are loosened, and the two positioning bolts 115 are unscrewed, so that each of the two lower uprights 31 the lower frame 30 can be moved relative to the respective main upright 11 of the main frame 10, so as to adjust the distance between the lower frame 30 and the main frame 10. Then, the two fixing devices 60 mounted on the two lower uprights 31 are clamped, and the two positioning bolts 115 are tightened, so that each of the two lower uprights 31 the lower frame 30 is fixed on the respective main upright 11 of the main frame 10.

On the other hand, the two fixing devices 60 mounted on the two main uprights 11 are loosened. Then, the press button 53 of the retraction control unit 50 is pressed upward, so that the two linking members 52 are pivoted to press and move the two operation rods 55 downward. Then, each of the two operation rods 55 pushes the control plate 561 of each of the two control seats 56 to pivot, thereby forcing the locking member 562 of each of the two control seats 56 to move toward the restoring spring 563, thereby detaching the locking stub 564 of the locking member 562 of each of the two control seats 56 from the respective positioning hole 112 of the respective main upright 11, so that each of the two upper uprights 21 can be released from and moved on the respective main upright 11, so as to adjust the distance between the upper frame 20 and the main frame 10.

After each of the two upper uprights 21 is moved to the desired position, the press button 53 is released, so that the press button 53, the two linking members 52, the two operation rods 55, the control plates 561 and the locking members 562 are returned to the original position by the restoring force of the compression spring 54 and the restoring spring 563, and the locking stub 564 of the locking member 562 of each of the two control seats 56 is locked in another one of the positioning holes 112 of the respective main upright 11, so that each of the two upper uprights 21 is fixed on the respective main upright 11 again.

Figure 7:
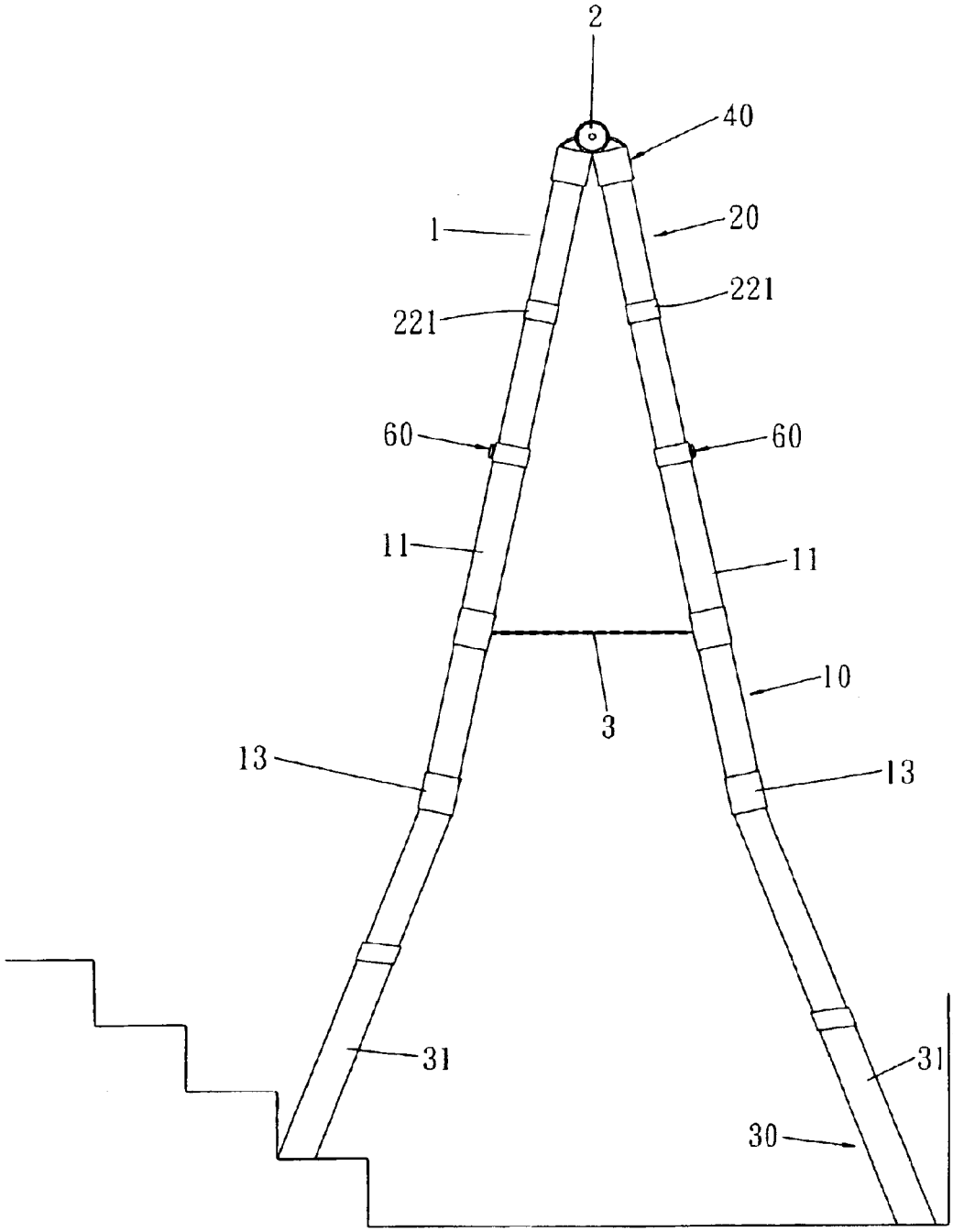
FIG. 7 is a schematic plan operational view of the ladder assembly as shown in FIG. 3 in use.

Referring to FIG. 7, the distance between the upper frame 20 and the main frame 10 and the distance between the lower frame 30 and the main frame 10 of one of the two support stands 1 can be adjusted individually, so that the ladder assembly is available for an uneven site.

Figure 8:
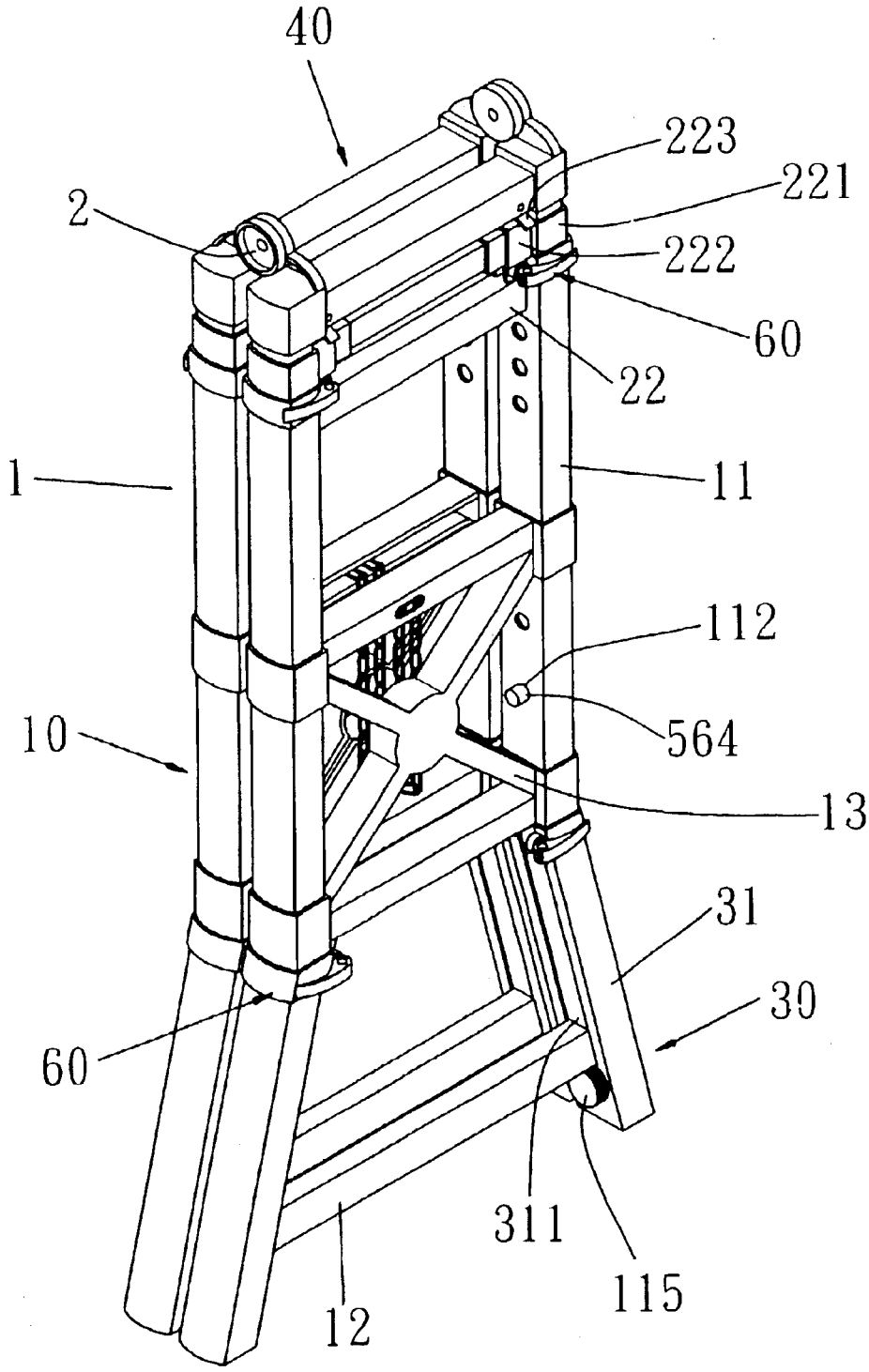
FIG. 8 is a perspective folded view of the ladder assembly in accordance with the preferred embodiment of the present invention.

Referring to FIG. 8, the two fixing devices 60 mounted on the two lower uprights 31 of the lower frame 30 are loosened, and the two positioning bolts 115 are unscrewed, so that the two lower uprights 31 can be moved upward to the uppermost position, so as to fold the lower frame 30. Then, the clip 222 and the quick release member 223 are loosened, so that the movable crossbar 22 of the upper frame 20 can be moved upward to the uppermost position to abut the top bar 40. Then, the two fixing devices 60 mounted on the two main uprights 11 are loosened, and the press button 53 of the retraction control unit 50 is pressed upward, so that each of the two upper uprights 21 can be detached from and moved downward to the lowermost position, so as to fold the upper frame 20.

Accordingly, the upper frame 20 and the lower frame 30 can be folded on the main frame 10, so as to reduce the volume the ladder assembly efficiently, thereby greatly facilitating storage and transportation of the ladder assembly. In addition, the height of the ladder assembly can be adjusted easily and conveniently, thereby facilitating the user operating the ladder assembly. Further, the distance between the upper frame 20 and the main frame 10 and the distance between the lower frame 30 and the main frame 10 of each of the two support stands 1 can be adjusted individually, so that the ladder assembly is available for an uneven or rugged site.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ladder assembly, comprising two symmetric support stands pivotally connected with each other, wherein:

each of the two support stands includes a main frame, an upper frame, and a lower frame;

the main frame of each of the two support stands includes two main uprights each having an inner side face having an upper end formed with a plurality of positioning holes;

the upper frame of each of the two support stands is mounted on an upper portion of the main frame and includes two upper uprights each adjustably mounted on an upper portion of a respective one of the two main uprights of the main frame;

the lower frame of each of the two support stands is mounted on a lower portion of the main frame and includes two lower uprights each adjustably mounted on a lower portion of a respective one of the two main uprights of the main frame;

each of the two support stands further includes a retraction control unit including a support seat, two linking members, a press button, two operation rods, and two control seats, wherein:

the support seat is formed with an operation slot;

each of the two linking members is pivotally mounted on the support seat;

the press button is slidably mounted in the operation slot of the support seat and has two ends each rested on a first end of a respective one of the two linking members;

each of the two operation rods is slidably mounted in a respective one of the two upper uprights of the upper frame and has an upper end pivotally mounted on a second end of a respective one of the two linking members; and each of the two control seats includes a hollow body formed with a through hole, a locking member slidably mounted in the hollow body and provided with a locking stub extended through the through hole and detachably locked in one of the positioning holes of a respective one of the two main uprights of the main frame.

2. The ladder assembly in accordance with claim 1, wherein the main frame of each of the two support stands includes two crossbars each mounted between the two main uprights, and a support strut mounted between the two main uprights.

3. The ladder assembly in accordance with claim 1, wherein the upper end of the inner side face of each of the two main uprights is formed with a longitudinal channel.

4. The ladder assembly in accordance with claim 1, wherein the inner side face of each of the two main uprights has a lower end formed with a through hole, and the main frame of each of the two support stands further includes two locking nuts each mounted in a respective one of the two main uprights, and two positioning bolts each extended through the through hole of a respective one of the two main uprights and each screwed into a respective one of the two locking nuts.

5. The ladder assembly in accordance with claim 4, wherein each of the two lower uprights of the lower frame of each of the two support stands has an inner side face formed with an elongated guide slot to receive a respective one of the two positioning bolts.

6. The ladder assembly in accordance with claim 1, wherein the upper frame of each of the two support stands has a movable crossbar mounted between the upper uprights.

7. The ladder assembly in accordance with claim 6, wherein the movable crossbar of the upper frame of each of the two support stands has two ends each combined with a fastener member which is fixed on the respective upper upright by a clip and a quick release member.

8. The ladder assembly in accordance with claim 1, wherein each of the two support stands further includes a top bar mounted on an upper portion of the upper frame and having a bottom face formed with a receiving chamber, and the support seat of the retraction control unit is mounted in the receiving chamber of the top bar.

9. The ladder assembly in accordance with claim 8, wherein the retraction control unit further includes a compression spring mounted in the receiving chamber of the top bar and urged between the press button and a top wall of the top bar.

10. The ladder assembly in accordance with claim 1, wherein each of the two control seats of the retraction control unit is mounted on a lower end of a respective one of the two upper uprights of the upper frame to move therewith.

11. The ladder assembly in accordance with claim 1, wherein each of the two control seats of the retraction control unit further includes a control plate pivotally mounted in the hollow body and having a first end connected to a lower end of a respective one of the two operation rods and a second end connected to the locking member for moving the locking member to detach from the respective positioning hole.

12. The ladder assembly in accordance with claim 1, wherein each of the two control seats of the retraction control unit further includes a restoring spring mounted in the hollow body and urged between the locking member and a wall of the hollow body.

13. The ladder assembly in accordance with claim 1, wherein each of the two support stands further includes two fixing devices to combine the two upper uprights on the two main uprights.

14. The ladder assembly in accordance with claim 13, wherein each of the fixing devices includes a clamping member and a quick release member.

15. The ladder assembly in accordance with claim 1, wherein each of the two support stands further includes two fixing devices to combine the two lower uprights on the two main uprights.

16. The ladder assembly in accordance with claim 15, wherein each of the fixing devices includes a clamping member and a quick release member.

* * * * *